US007588392B2

(12) United States Patent
Wroblewski et al.

(10) Patent No.: US 7,588,392 B2
(45) Date of Patent: Sep. 15, 2009

(54) REMOVABLE GRATE

(75) Inventors: Doug Wroblewski, Erie, PA (US); Kevin D. Himes, Mount Wolf, PA (US); Patrick Slater, Waterford, PA (US); Douglas Dalton, Jamestown, NY (US); David A. Ecklund, Jamestown, NY (US); Joseph A. Sanfilippo, Jamestown, NY (US)

(73) Assignee: Zurn Industries, LLC, Erie, PA (US)

( * ) Notice: Subject to any disclaimer, the term of this patent is extended or adjusted under 35 U.S.C. 154(b) by 224 days.

(21) Appl. No.: 11/789,444

(22) Filed: Apr. 24, 2007

(65) Prior Publication Data

US 2008/0014022 A1 Jan. 17, 2008

Related U.S. Application Data

(60) Provisional application No. 60/794,377, filed on Apr. 24, 2006.

(51) Int. Cl.
*E03F 5/06* (2006.01)

(52) U.S. Cl. ..... 405/118; 405/119; 210/163; 210/164; 404/4

(58) Field of Classification Search ..... 405/118–123; 210/163, 164; 404/2, 4
See application file for complete search history.

(56) References Cited

U.S. PATENT DOCUMENTS

| | | | | |
|---|---|---|---|---|
| 386,768 | A | | 7/1888 | Burrows |
| 967,940 | A | | 8/1910 | Kurz |
| 1,035,480 | A | | 8/1912 | Schodde |
| 1,712,267 | A | | 5/1929 | Gschwind |
| 1,988,360 | A | | 1/1935 | Moore |
| 2,323,886 | A | | 7/1943 | Wirz, Jr. |
| 4,126,404 | A | | 11/1978 | Ferns |
| 4,621,939 | A | | 11/1986 | Thomann et al. |
| 4,640,643 | A | * | 2/1987 | Williams ..... 405/118 |
| 4,952,094 | A | | 8/1990 | Spiess et al. |
| 4,955,752 | A | | 9/1990 | Ferns |
| D312,696 | S | | 12/1990 | Phillips |
| 5,026,202 | A | * | 6/1991 | Thomann ..... 405/118 |
| 5,066,165 | A | * | 11/1991 | Wofford et al. ..... 405/118 |
| 5,110,235 | A | | 5/1992 | Thomann et al. |
| 5,324,135 | A | | 6/1994 | Smith |
| 5,340,234 | A | * | 8/1994 | Rossi et al. ..... 405/119 |
| 5,462,382 | A | | 10/1995 | Sauerwein et al. |

(Continued)

FOREIGN PATENT DOCUMENTS

EP 0 790 360 A1 8/1997

(Continued)

*Primary Examiner*—Frederick L Lagman
(74) *Attorney, Agent, or Firm*—The Webb Law Firm

(57) ABSTRACT

A two-part grate assembly for a channeled drain trough. The grate assembly has a grate frame that receives a removable grate section. The grate frame has lugs with vertical projections extending therefrom that define securing recesses that assist in aligning and securing the grate frame atop a drain trough. Additionally, the present invention is directed to the use of an alignment bar that prevents the grate section from sliding out of operating position within the grate frame by restricting lateral movement of the grate section. Further, the present invention is directed to a method of providing a grate assembly for a channeled drain trough having a grate frame that is adapted to receive a removable grate section.

19 Claims, 8 Drawing Sheets

U.S. PATENT DOCUMENTS

| | | | | |
|---|---|---|---|---|
| 5,628,152 | A | 5/1997 | Bowman | |
| 5,971,662 | A | 10/1999 | Becker et al. | |
| 6,027,283 | A | 2/2000 | Schweinberg et al. | |
| 6,170,095 | B1 * | 1/2001 | Zars | 4/507 |
| 6,443,656 | B1 | 9/2002 | Gunter | |
| 6,533,497 | B2 | 3/2003 | Gunter | |
| 6,612,780 | B2 | 9/2003 | Dahowski et al. | |
| 7,048,466 | B2 * | 5/2006 | Benesteau et al. | 405/119 |
| 7,311,844 | B1 * | 12/2007 | Joyner et al. | 210/164 |
| 7,413,372 | B2 * | 8/2008 | Meyers | 404/2 |
| 2003/0147693 | A1 * | 8/2003 | Knak et al. | 404/4 |
| 2006/0239773 | A1 * | 10/2006 | Meyers | 404/2 |

FOREIGN PATENT DOCUMENTS

| | | | |
|---|---|---|---|
| EP | 0 886 012 | A1 | 12/1998 |
| EP | 1 690 987 | A1 | 8/2006 |
| WO | WO 03/076729 | A1 | 9/2003 |
| WO | WO 2004/072391 | A1 | 8/2004 |
| WO | WO 2005/038150 | A1 | 4/2005 |
| WO | WO 2006/005617 | A1 | 1/2006 |

* cited by examiner

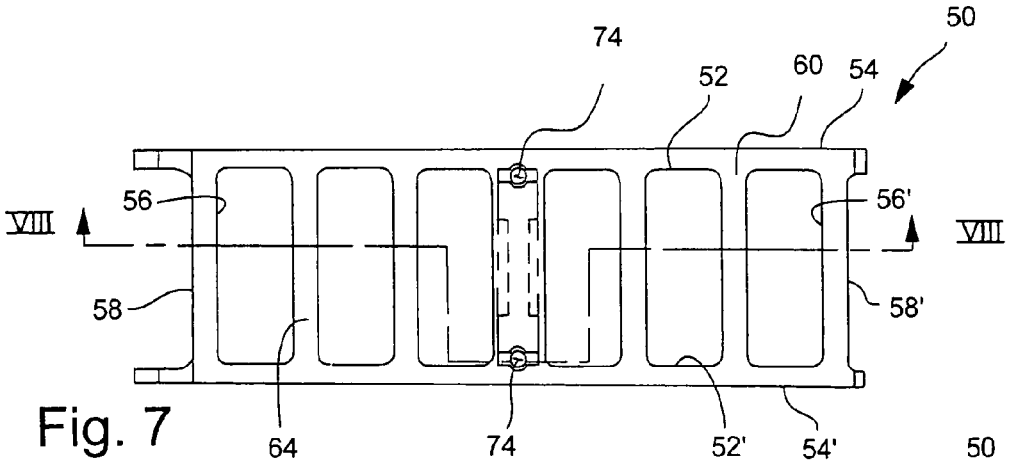
Fig. 7
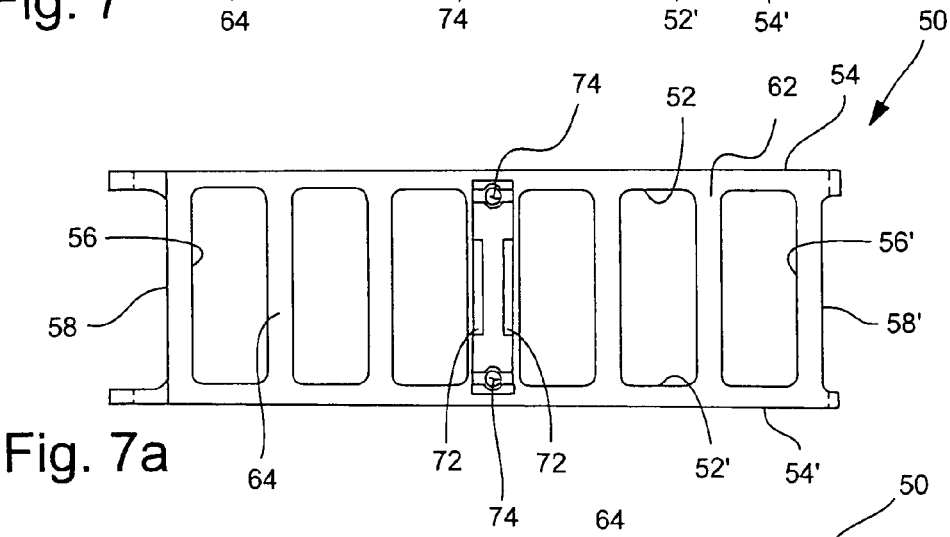
Fig. 7a
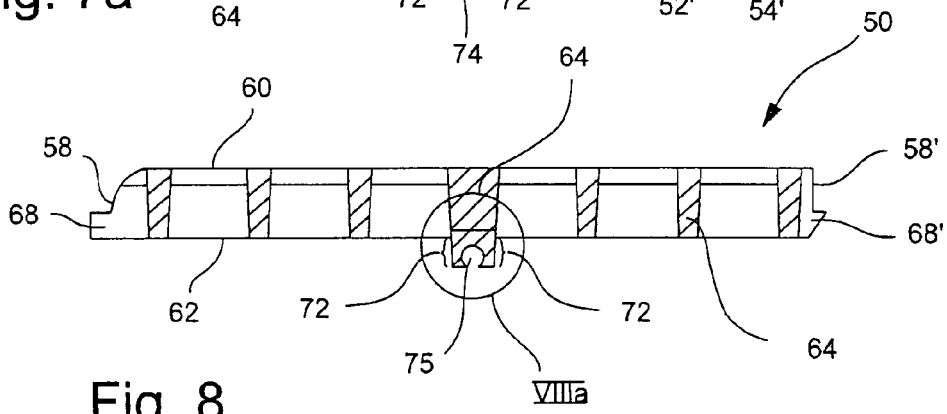
Fig. 8
Fig. 8a
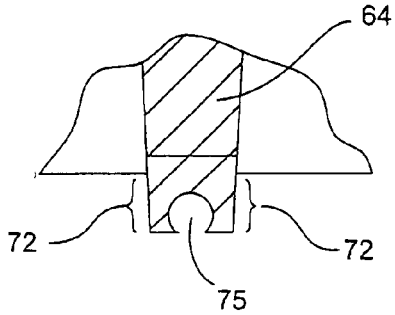

REMOVABLE GRATE

CROSS REFERENCE TO RELATED APPLICATION

This application is based on Provisional Patent Application No. 60/794,377 filed Apr. 24, 2006, on which priority of this patent application is based, and which is hereby incorporated by reference in its entirety.

BACKGROUND OF THE INVENTION.

1. Field of the Invention

The present invention relates generally to a two-part grate assembly for a channeled drain trough and, more particularly, to a grate assembly having a grate frame that is adapted to receive a removable grate section.

2. Description of Related Art

Channeled drains, such as trench drains, are utilized to transfer extensive amounts of liquid from one place to another and typically transport the liquid to a drainage sewer. Such drains are installed in the ground and secured within concrete. The drains are often U-shaped or V-shaped troughs and are usually installed adjacent to either roadways or buildings. To prevent injury to people and avoid debris entering the trench drains, a grate often covers the trough. In many cases, the channeled drains include a grate to prevent large objects, such as debris and people, from falling into them. However, there are many instances where access to the interior of the trough is desirable and it can be difficult, expensive, and time-consuming to remove the desired section of the grate from the trough in order to access the interior of the trough.

Thus, it is an object of the present invention to provide an improved grate assembly for a channeled drain trough that allows access to the interior of the trough in an expedient and time-efficient manner.

SUMMARY OF THE INVENTION

Generally, the present invention is directed to a two-part grate assembly for a channeled drain trough and, more particularly, to a grate assembly having a grate frame that is adapted to receive a removable grate section. Further, the present invention is directed to a grate frame having lugs with vertical projections extending therefrom that define securing recesses that assist in aligning and securing the grate frame atop a drain trough. Additionally, the present invention is directed to the use of an alignment bar that prevents the grate section from sliding out of operating position within the grate frame by restricting lateral movement of the grate section. Further, the present invention is directed to a method of providing a grate assembly for a channeled drain trough having a grate frame that is adapted to receive a removable grate section.

The present invention is directed to a removable grate assembly for a channeled drain trough having a grate frame with a first section defining a first section interior endwall and a first section exterior endwall and a second section defining a second section interior endwall and a second section exterior endwall. The first section interior endwall and the second section interior endwall are connected by two opposing sidewalls. The first section extends inwardly toward the first section interior endwall to form an internal projection defining a receiving recess on a side of the first interior endwall and the second section extends inwardly toward the second section interior endwall to form an internal projection defining a receiving recess on the second interior endwall.

A grate section is also provided having a first interior endwall, a first exterior endwall, a second interior endwall, and a second exterior endwall. The first interior endwall and the second interior endwall are connected by two opposing sidewalls. The first exterior endwall has an external projection extending therefrom on a side of the first exterior endwall and the second exterior endwall has an external projection extending therefrom on a side of the second exterior endwall.

The removable grate section is removably received by the grate frame when the external projection of the first exterior endwall is received within its corresponding receiving recess of the first interior endwall. Further, the external projection of the second exterior endwall is received within its corresponding receiving recess of the second interior endwall.

The present invention is also directed to a removable grate assembly for a channeled drain trough having a grate frame that has a first section defining a first section interior endwall and a first section exterior endwall and a second section defining a second section interior endwall and a second section exterior endwall. The first section interior endwall and the second section interior endwall are connected by two opposing sidewalls. The first section extends inwardly toward the first section interior endwall to form an internal projection defining a receiving recess on a side of the first interior endwall. The internal projection of the first section is substantially rectangular in shape. The second section extends inwardly toward the second section interior endwall to form an internal projection defining a receiving recess on the second interior endwall. The internal projection of the second section extends in a horizontal direction. The grate frame also defines a slot on a first of the two opposing sidewalls that extends from an inner surface of an interior surface of the first opposing sidewall toward a respective outer surface of an exterior surface of the first opposing sidewall. The grate frame further defines a slot on a second of the two opposing sidewalls that extends from an inner surface of an interior surface of the second opposing sidewall toward a respective outer surface of an exterior surface of the second opposing sidewall.

A removable grate section is also provided having a first interior endwall, a first exterior endwall, a second interior endwall, and a second exterior endwall. The first interior endwall and the second interior endwall are connected by two opposing sidewalls. The first exterior endwall has an external projection extending therefrom on a side of the first exterior endwall. The external projection of the first exterior endwall is substantially rectangular in shape. The second exterior endwall has an external projection extending therefrom on a side of the second exterior endwall. The external projection of the second exterior endwall extends in a horizontal direction.

The removable grate section is removably received by the grate frame when the external projection of the first exterior endwall is received within its corresponding receiving recess of the first interior endwall and the external projection of the second exterior endwall is received within its corresponding receiving recess of the second interior endwall.

Further, an alignment bar that extends throughout the width of the grate frame is provided. The alignment bar engages the grate frame and the grate section to prevent lateral movement of the grate section secured within the grate frame when the alignment bar is removably received into the slots.

The present invention is also directed to a removable grate assembly for a channeled drain trough having a grate frame with a first section defining a first section interior endwall and a first section exterior endwall and a second section defining a second section interior endwall and a second section exterior endwall. The first section interior endwall and the second section interior endwall are connected by two opposing sidewalls. The first section extends inwardly toward the first section interior endwall to form an internal projection defining a receiving recess on a side of the first interior endwall and the second section extends inwardly toward the second section interior endwall to form an internal projection defining a receiving recess on the second interior endwall.

A grate section is also provided having a first interior endwall, a first exterior endwall, a second interior endwall, and a second exterior endwall. The first interior endwall and the second interior endwall are connected by two opposing sidewalls. The first exterior endwall has an external projection extending therefrom on a side of the first exterior endwall and the second exterior endwall has an external projection extending therefrom on a side of the second exterior endwall.

The removable grate section is removably received by the grate frame when the external projection of the first exterior endwall is received within its corresponding receiving recess of the first interior endwall. Further, the external projection of the second exterior endwall is received within its corresponding receiving recess of the second interior endwall.

Further, a drain trough that is substantially U-shaped having a hollow body portion and a ledge is provided. The grate frame intended to be placed atop the ledge of the drain trough.

The present invention is further directed to a removable grate assembly having a grate frame with a body that defines an external surface and an internal surface. The internal surface defines a grate receiving recess. Further, the body has a horizontally extending lug extending from the external surface of the grate frame. A projection depends from the lug to define a securing recess between a portion of the external surface, at least a portion of the lug and at least a portion of the projection. A grate received by the grate receiving recess is also provided.

The present invention is directed to a method for providing a removable grate assembly for a channeled drain trough. The method includes providing a grate frame with a first section defining a first section interior endwall and a first section exterior endwall and a second section defining a second section interior endwall and a second section exterior endwall. The first section interior endwall and the second section interior endwall are connected by two opposing sidewalls. The first section extends inwardly toward the first section interior endwall to form an internal projection defining a receiving recess on a side of the first interior endwall and the second section extends inwardly toward the second section interior endwall to form an internal projection defining a receiving recess on the second interior endwall. The method further includes providing a grate section having a first interior endwall, a first exterior endwall, a second interior endwall, and a second exterior endwall. The first interior endwall and the second interior endwall are connected by two opposing sidewalls. The first exterior endwall has an external projection extending therefrom on a side of the first exterior endwall and the second exterior endwall has an external projection extending therefrom on a side of the second exterior endwall. The removable grate section is removably received by the grate frame when the external projection of the first exterior endwall is received within its corresponding receiving recess of the first interior endwall. Further, the external projection of the second exterior endwall is received within its corresponding receiving recess of the second interior endwall. Further, an alignment bar is provided. The method further includes aligning and placing the grate frame over a channeled drain trough and inserting the grate section into the grate frame, inserting the alignment bar into a slot on a first of the two opposing sidewalls of the grate frame and into a slot on a second of the two opposing sidewalls of the grate frame, whereby the alignment bar extends throughout the width of the grate frame and whereby the alignment bar engages the grate frame and the grate section to prevent lateral movement of the grate section secured within the grate frame, and engaging the alignment bar with a clip attached to an extending portion of at least two interior ribwalls of the grate section, whereby the clip has first and second leg portions for releasably attaching the alignment bar thereto.

These and other advantages of the present invention will be understood from the description of the preferred embodiments, taken with the accompanying drawings, wherein like reference numerals represent like elements throughout.

BRIEF DESCRIPTION OF THE DRAWINGS

FIG. 7 is a top plan view of the grate section of FIG. 3;

FIG. 7*a* is a bottom plan view of the grate section of FIG. 3;

FIG. 8 is a cross-sectional view of the grate section of FIG. 7 taken along lines VIII-VIII of FIG. 7;

FIG. 8*a* is a close-up, cross-sectional view of the grate section of FIG. 8 taken along circumscribed area VIIIa of FIG. 8;

DETAILED DESCRIPTION OF THE INVENTION

Figure 1:
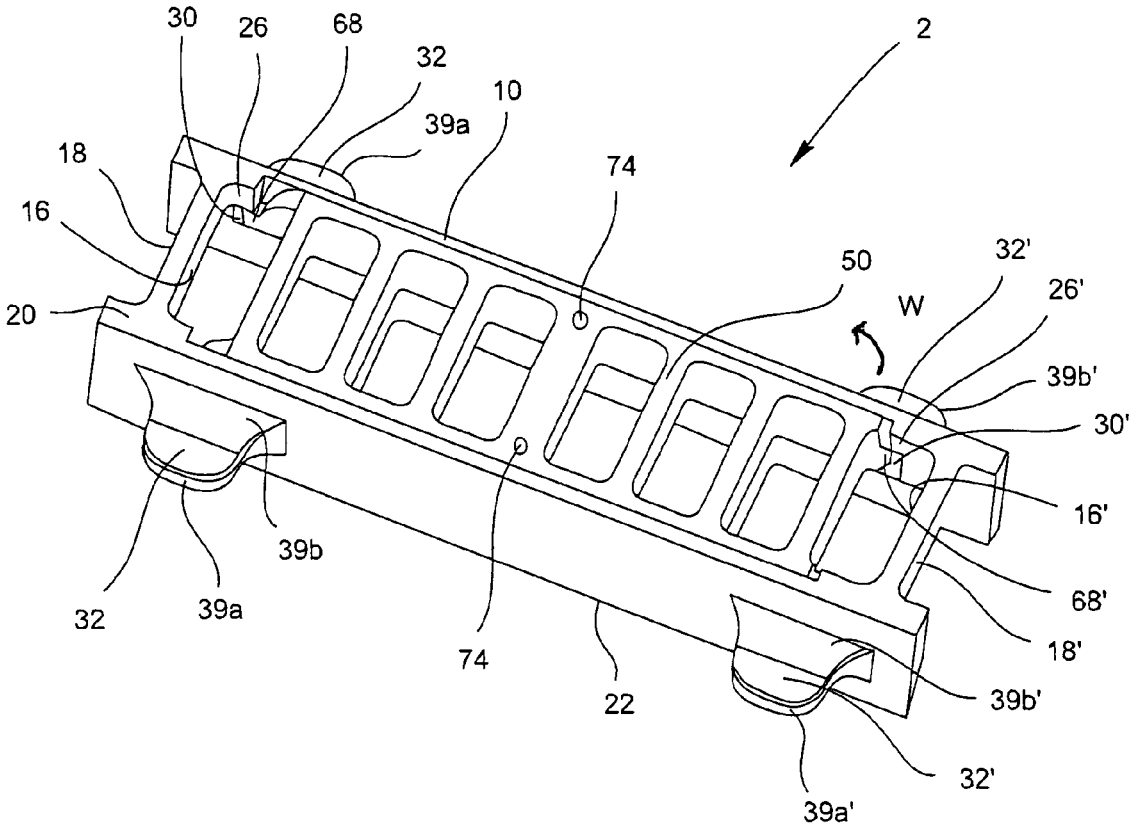
FIG. 1 is a perspective view of a two-part grate assembly for a channeled drain trough having a grate frame and a removable grate section in accordance with the present invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

FIG. 1 shows a two-part grate assembly 2 according to the present invention. The two-part grate assembly 2 has a grate frame 10 adapted to receive a removable grate or grate section 50. The grate section 50 is removable and is slidably received by the grate frame 10. The grate frame 10 and grate section 50 may be manufactured out of cast iron, ductile iron, and/or stainless steel, as well as any other material such as polymeric materials.

Figure 2:
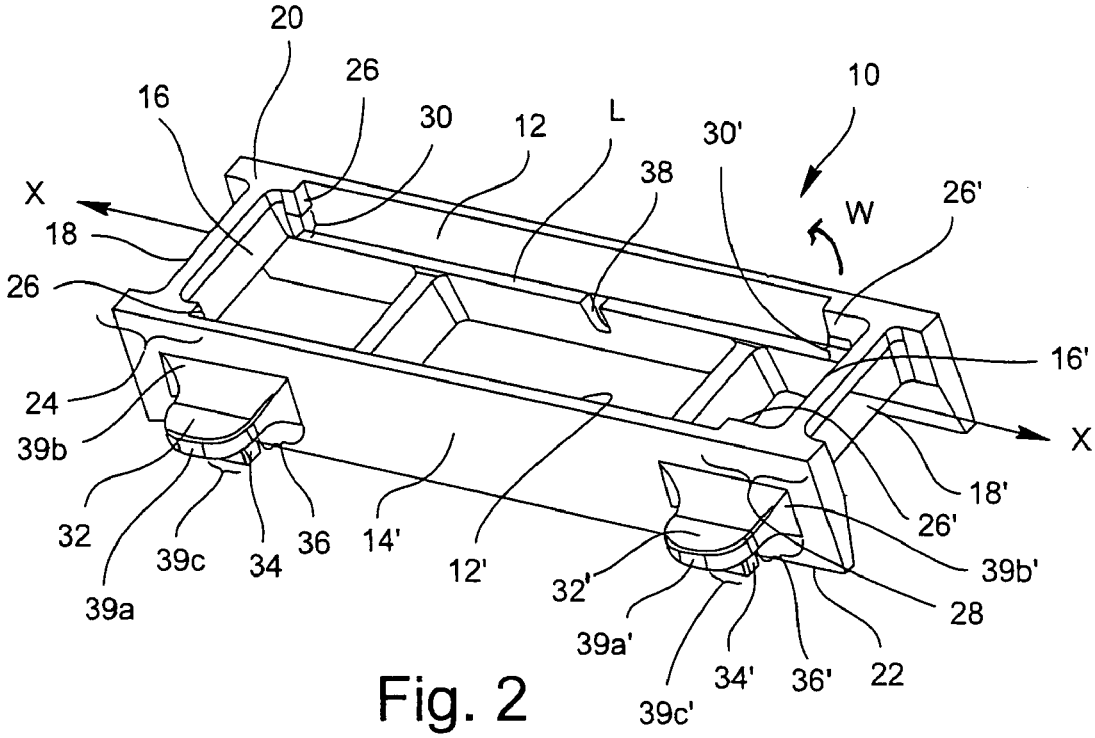
FIG. 2 is a perspective view of the grate frame of FIG. 1.
Figure 3:
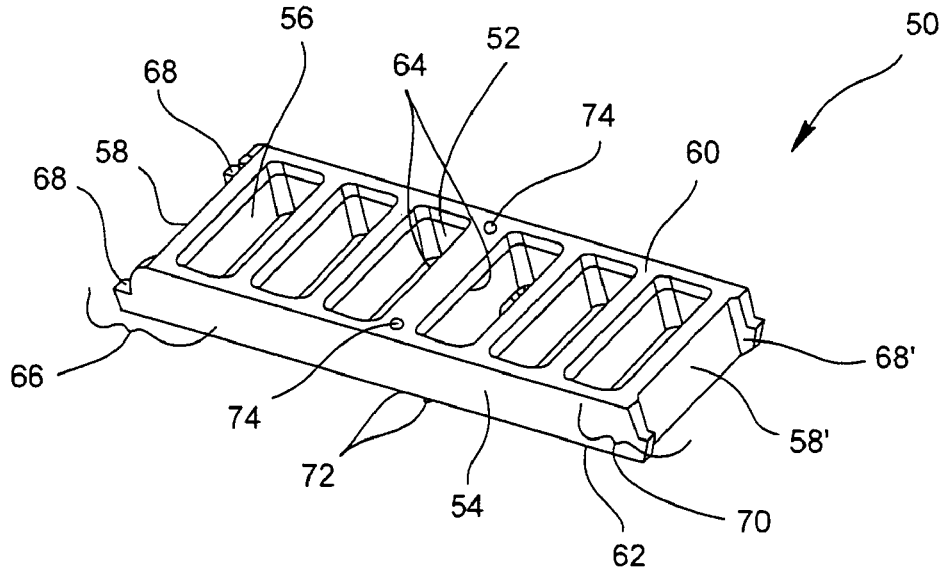
FIG. 3 is a perspective view of the removable grate section of FIG. 1.
Figure 4:
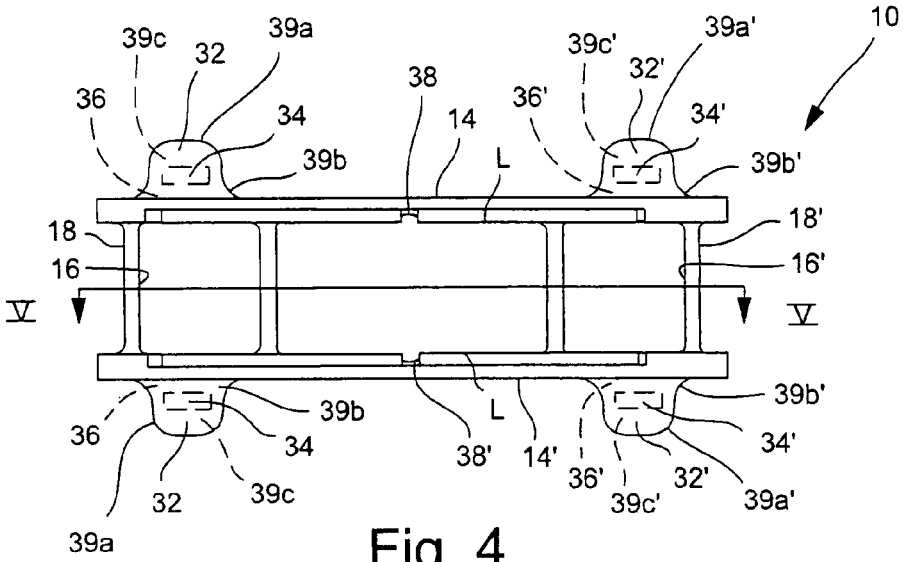
FIG. 4 is a top plan view of the grate frame of FIG. 1.

FIG. 2 shows an un-mated grate frame 10 according to the present invention and FIG. 3 shows an un-mated grate section 50 according to the present invention. As shown in FIGS. 1-2, 4 and 10, the grate frame 10 is essentially rectangular in shape with opposing interior sidewalls 12 and 12' and opposing exterior sidewalls 14 and 14'. Further, the grate frame 10 has opposing interior endwalls 16 and 16', one at the first section or front portion 24 of the grate frame 10 and one at the second section or rear portion 28 of the grate frame 10. The grate frame 10 also has opposing exterior endwalls 18 and 18', one at the first section or front portion 24 of the grate frame 10 and one at the second section or rear portion 28 of the grate frame 10. Further, the grate frame 10 has a first or top surface 20 and a second or bottom surface 22. The first section or front portion 24 of the grate frame 10 extends inwardly to form an internal projection 26 on opposing sides of the interior endwall 16 along each respective interior sidewall 12 and 12'. Further, the second section or rear portion 28 of the grate frame 10 extends inwardly to form an internal projection 26' on opposing sides of the interior endwall 16' along each respective interior sidewall 12 and 12'. Each internal projection 26 and 26' defines a receiving recess 30 and 30', respectively. Receiving recesses 30 are substantially rectangular in shape to matingly receive external projections 68 and receiving recesses 30' are extend in a horizontal direction to matingly receive external projections 68'. Alternatively, receiving recesses 30' may be downwardly sloped and external projections 68' may be upwardly sloped. Each internal projection 26 at the first section or front portion 24 of the grate frame 10 is substantially rectangular in shape and each internal projection 26' at the second section or rear portion 28 of the grate frame 10 extends in a horizontal direction. The internal projections 26 and 26' are positioned on opposing interior endwalls 12 and 12', respectively. A ledge L is defined on each interior sidewall 12 and 12'. A bottom surface of each internal projection 26 and 26' is substantially parallel to an upper surface of ledge L.

As shown in FIGS. 1, 2, 4 and 10, the grate frame 10 also has a lug 32 or 32' extending outwardly from the opposing exterior sidewalls 14 and 14'. Specifically, a pair of lugs 32 is located on the first section or front portion 24 of the grate frame 10 and a pair of lugs 32' is located on the second or rear portion 28 of the grate frame 10. Each lug 32 at the first section or front portion 24 of the grate frame 10 has a vertical projection 34 extending therefrom that defines a securing recess 36. Each lug 32' at the second section or rear portion 28 of the grate frame 10 has a vertical projection 34' extending therefrom that defines a securing recess 36'. Each lug 32 and 32' has a free end 39*a* and 39*a'*, respectively, and a connected end 39*b* and 39*b'*, respectively. Vertical projection 34 is positioned between free end 39*a* and connected end 39*b* and vertical projection 34' is positioned between free end 39*a'* and connected end 39*b'*. Locking recesses 39*c* and 39*c'* are defined by free ends 39*a* and 39*a'* and their respective vertical projections 34 and 34'. The securing recesses 36 and 36' assist in aligning and securing the grate frame 10 atop a channeled drain trough 4. The lugs 32 and 32' and vertical projections 34 and 34' further stabilize or lock the grate frame 10 when earthen fill or concrete is placed around the grate frame 10 and locking recesses 39*c* and 39*c'* and the channeled drain trough 4.

Figure 5:
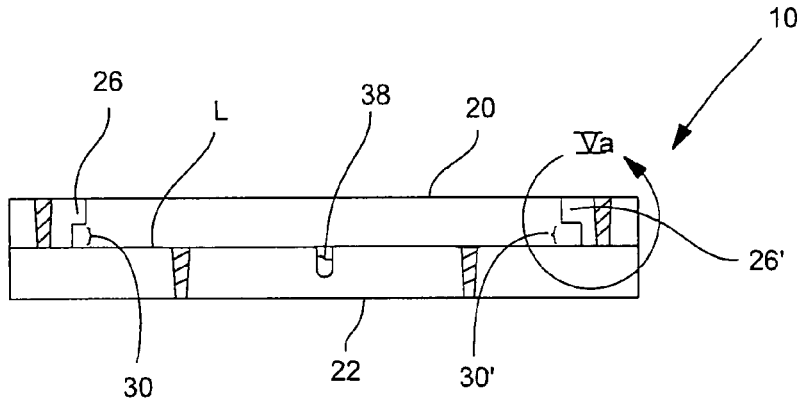
FIG. 5 is a cross-sectional view of the grate frame of FIG. 4 taken along lines V-V of FIG. 4.
Figure 5A:
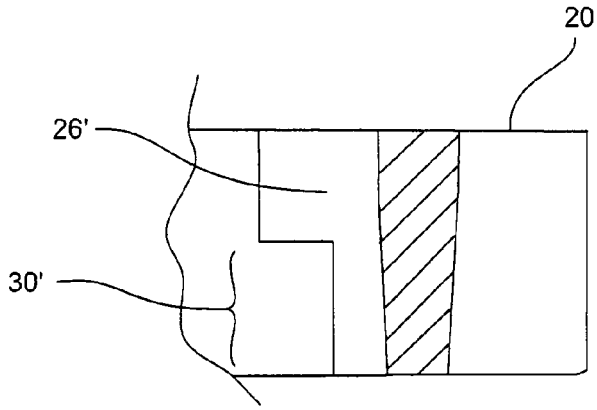
FIG. 5*a* is a close-up, cross-sectional view of the grate frame of FIG. 5 taken along circumscribed area Va of FIG. 5.
Figure 6:
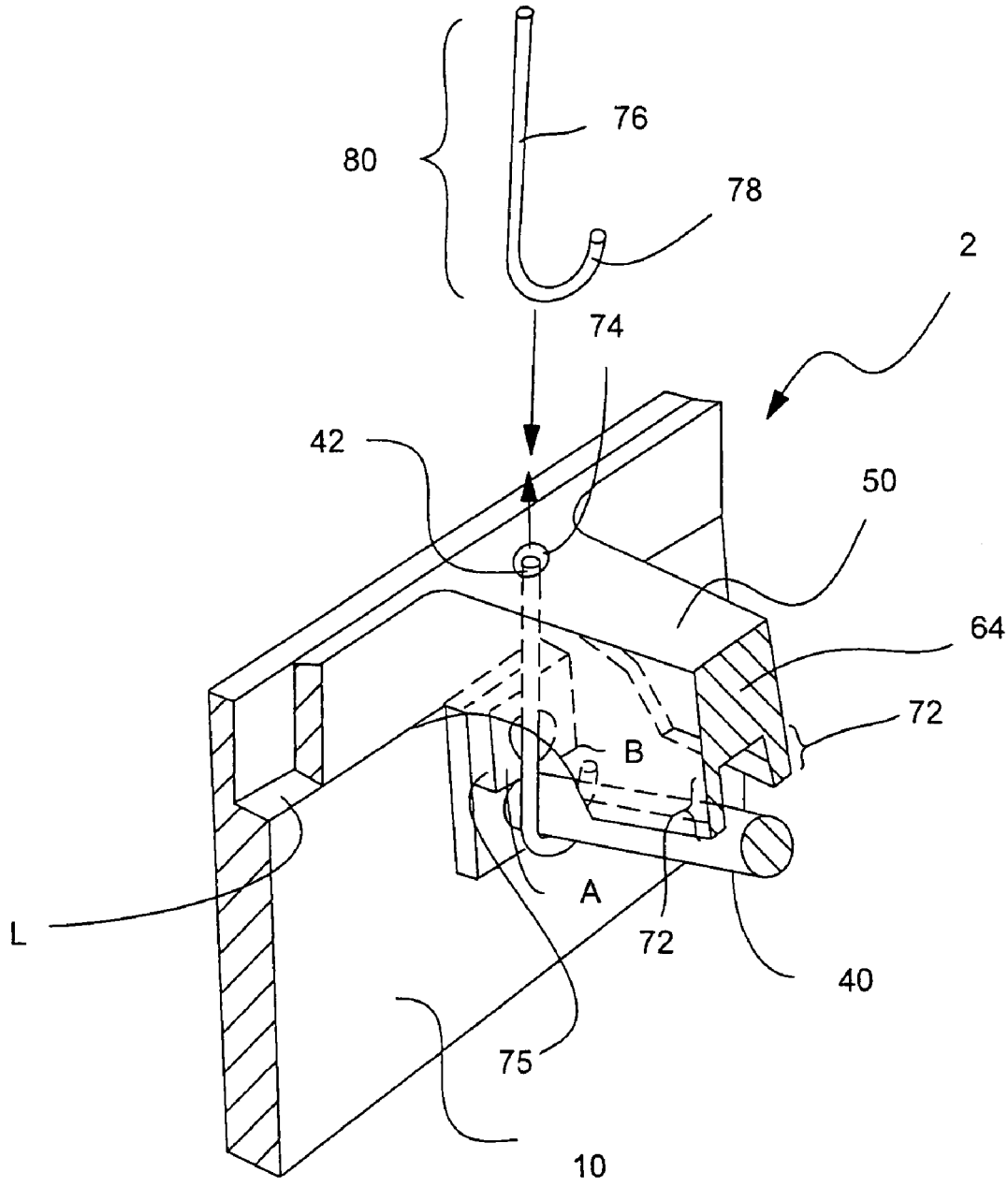
FIG. 6 is an interior perspective view of the two-part grate assembly of FIG. 1.

As shown in FIGS. 2, 5 and 6, the grate frame 10 further defines slots 38 and 38' (one of which is not shown in FIGS. 2 and 5) defined in the interior sidewalls 12 and 12' that extends from the inner surface of the interior sidewalls 12 and 12' toward, but not through, the respective outer surface of the exterior sidewalls 14 and 14'. The slots 38 and 38' are intended to receive an alignment bar 40 (not shown in FIGS. 2 and 5) throughout the width of the grate frame 10.

FIGS. 3, and 7-8*a* show an un-mated slotted grate section 50 according to the present invention. The grate section 50 is essentially rectangular in shape with opposing interior sidewalls 52 and 52' (of which one is shown in FIG. 3) and opposing exterior sidewalls 54 and 54'. Further, the grate section 50 has opposing interior endwalls 56 and 56' and opposing exterior endwalls 58 and 58'. Further, the grate section 50 has a first or top surface 60 and a second or bottom surface 62. The grate section 50 also has at least one interior ribwall 64 contained within its structure. A first or front portion 66 of the grate section 50 extends outwardly to form an external projection 68 on opposing sides the exterior endwall 58 along each respective exterior sidewall 54 and 54'. A second or rear portion 70 of the grate section 50 extends outwardly to form an external projection 68' on opposing sides of the exterior endwall 58' along each respective exterior sidewall 54 and 54'. The external projection 68 at the first or front portion 66 of the grate section 50 is substantially rectangular in shape and the external projection 68' at the second or rear portion 70 of the grate section 50 extends in a horizontal direction. As illustrated in FIG. 1, when the grate section 50 is received by the grate frame 10, each external projection 68 and 68' mates with its corresponding receiving recess 30 and 30', which helps to secure the grate section 50 within the grate frame 10. Upper surfaces of the external projections 68 and 68' extend in the horizontal direction and when installed, are parallel to the ledge L.

As shown in FIGS. 3, 6, 8 and 8*a*, at least two of the interior ribwalls 64 of the grate section 50 have extending portions 72 that protrude below the second or bottom surface 62 of the grate section 50. Further, as shown in FIGS. 1, 3, 6, 7, 7*a* and 10, a hole 74 is present that extends from the first or top surface 60 through the second or bottom surface 62 of the grate section 50. The hole 74 is spaced between the two interior ribwalls 64 having extending portions 72. The hole 74 is used to access and manipulate the alignment bar 40 contained throughout the width of the grate frame 10. The tool 76 is initially arranged so that the elongated portion 80 passes through the hole 74 and the hook end 78 is positioned below the alignment bar 40. The attachment of the alignment bar 40 is illustrated in FIG. 6, wherein a tool 76 having a hook end 78 and an elongated portion 80 has been positioned adjacent the two-part grate assembly 2 and the hook end 78 of the tool 76 captures a portion of the alignment bar 40 lifting the alignment bar 40 upwardly into place in the two-part grate assembly 2. The alignment bar 40 engages the grate frame 10 and the grate section 50 to prevent lateral movement along the X-axis shown in FIG. 2. The alignment bar 40 may also be brought into operating position by hand. The alignment bar 40 releasably engages with a clip 75 attached to extending portions 72. Preferably, two clips 75 are provided, each clip 75 attached to extending portions 72 near opposing interior sidewalls 52 and 52'. The clip 75 has legs A and B for releasably attaching the alignment bar 40 thereto. The tool 76 is then removed from the grate assembly 2. To detach the alignment bar 40, the elongated portion 80 of the tool 76 can be placed down through hole 74 forcing the alignment bar 40 downwardly out of the clip 75 for removal of the grate section 50.

Figure 9:
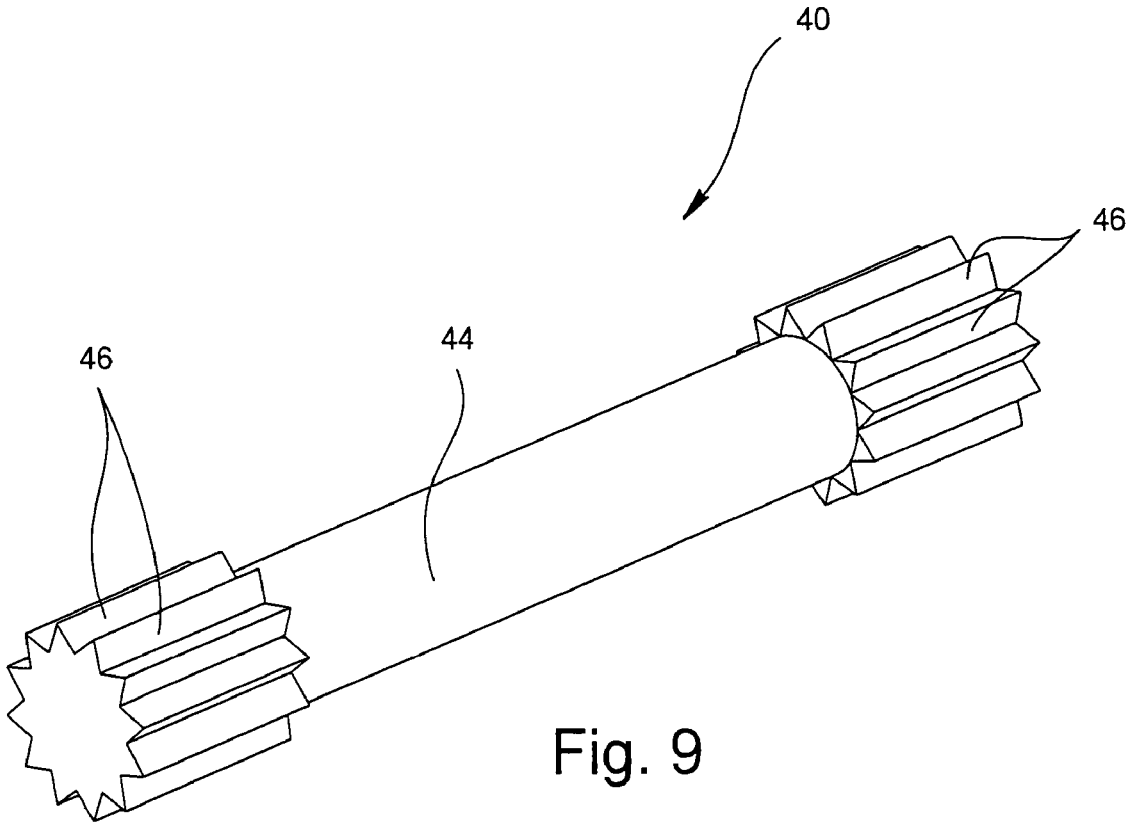
FIG. 9 is a front plan view of the alignment bar of FIG. 6.

As shown in FIG. 9, the alignment bar 40 has an intermediate or center portion 44 with a plurality of deformable fins 46 at opposing ends of the alignment bar 40. The entire alignment bar 40 may be manufactured out of a plastic or elastomeric material; however, any pliable material now known, or heretofore developed in the art, may be used. The center portion 44 of the alignment bar 40 may be manufactured out of any substantially non-deformable material, such as cast iron, ductile iron, and/or stainless steel, whereas the fins 46 are manufactured out of an elastically deformable material, such as a plastic material or elastomeric material. Upon insertion into at least one clip 75, the fins 46 deform inwardly when the alignment bar 40 is received and the memory of the material of the fins 46 allows the fins 46 to regain their shape. Thus, in operation, the ribbed fins 46 are frictionally engaged in the at least one clip 75 so that the alignment bar 40 is held into place. Upon removal, the fins 46 are once more deformed and the alignment bar 40 is released so that the grate section 50 may be removed from the grate frame 10. The extending portions 72 may be somewhat flexible, as well as resilient, and also function to receive and hold the alignment bar 40 in place.

Figure 10:
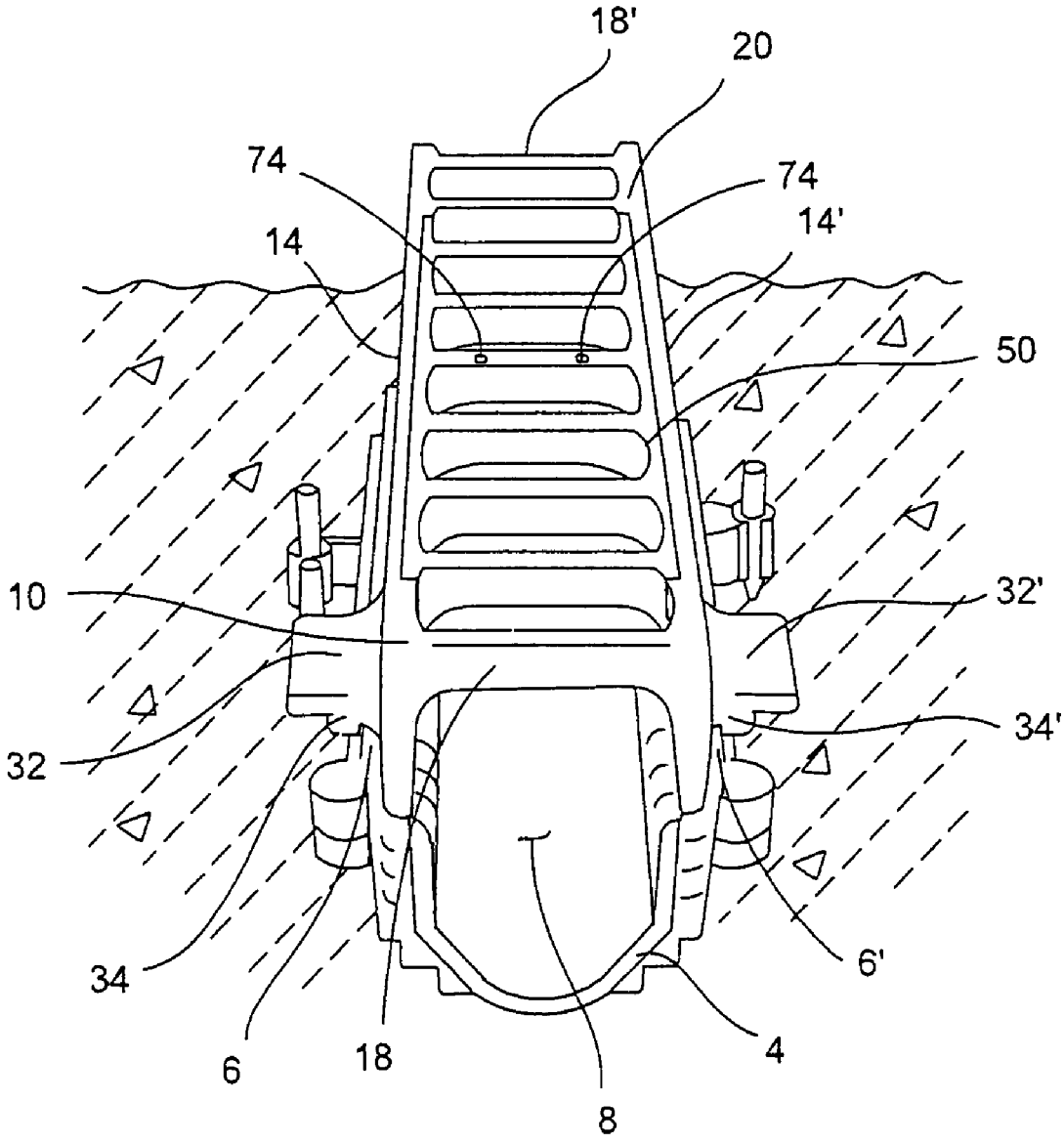
FIG. 10 is an elevated perspective end view of the two-part grate assembly of FIG. 1 placed atop a channeled drain trough.
Figure 11:
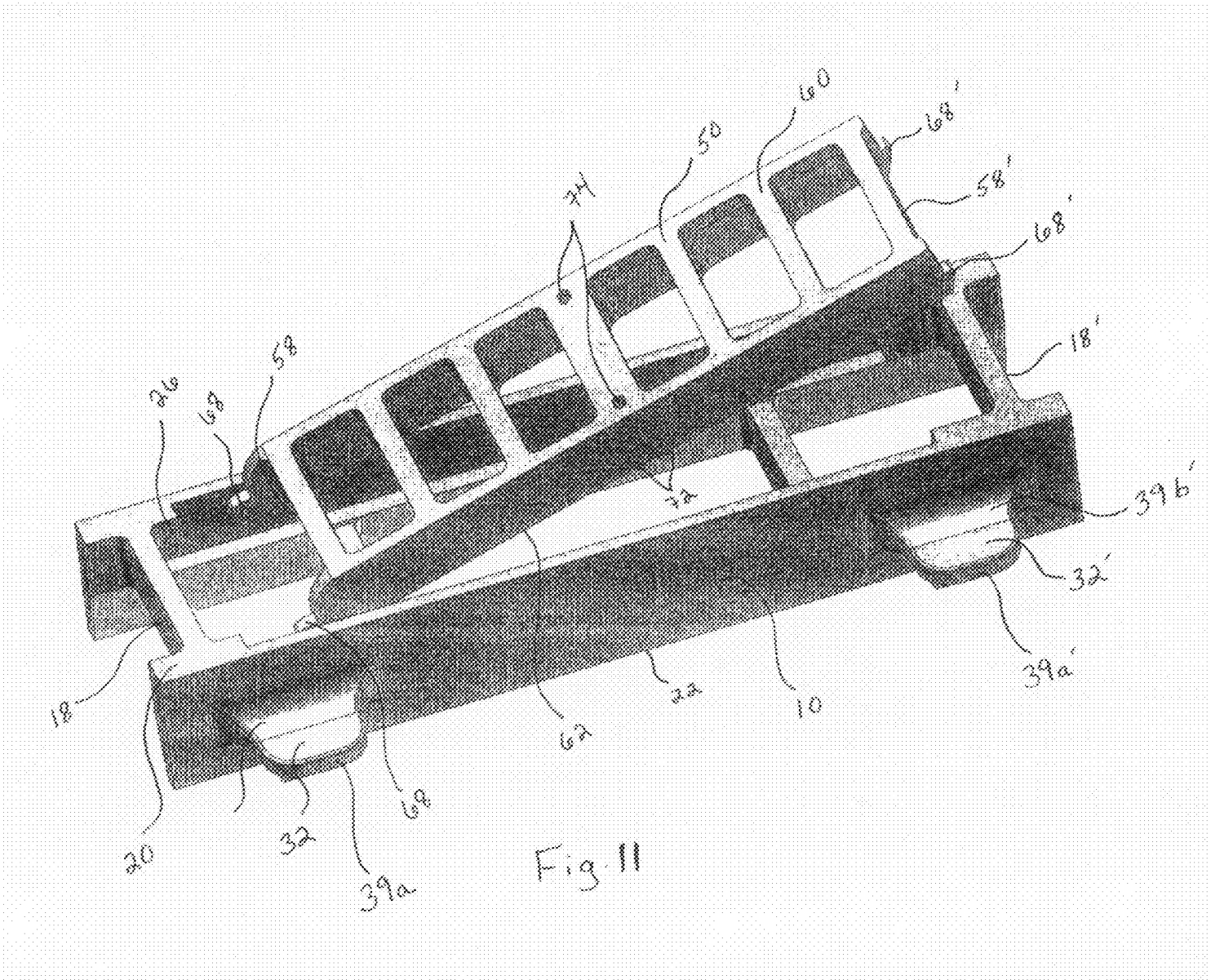
FIG. 11 is a top perspective view of the grate frame of the present invention in the process of receiving the grate section of the present invention.
Figure 11:
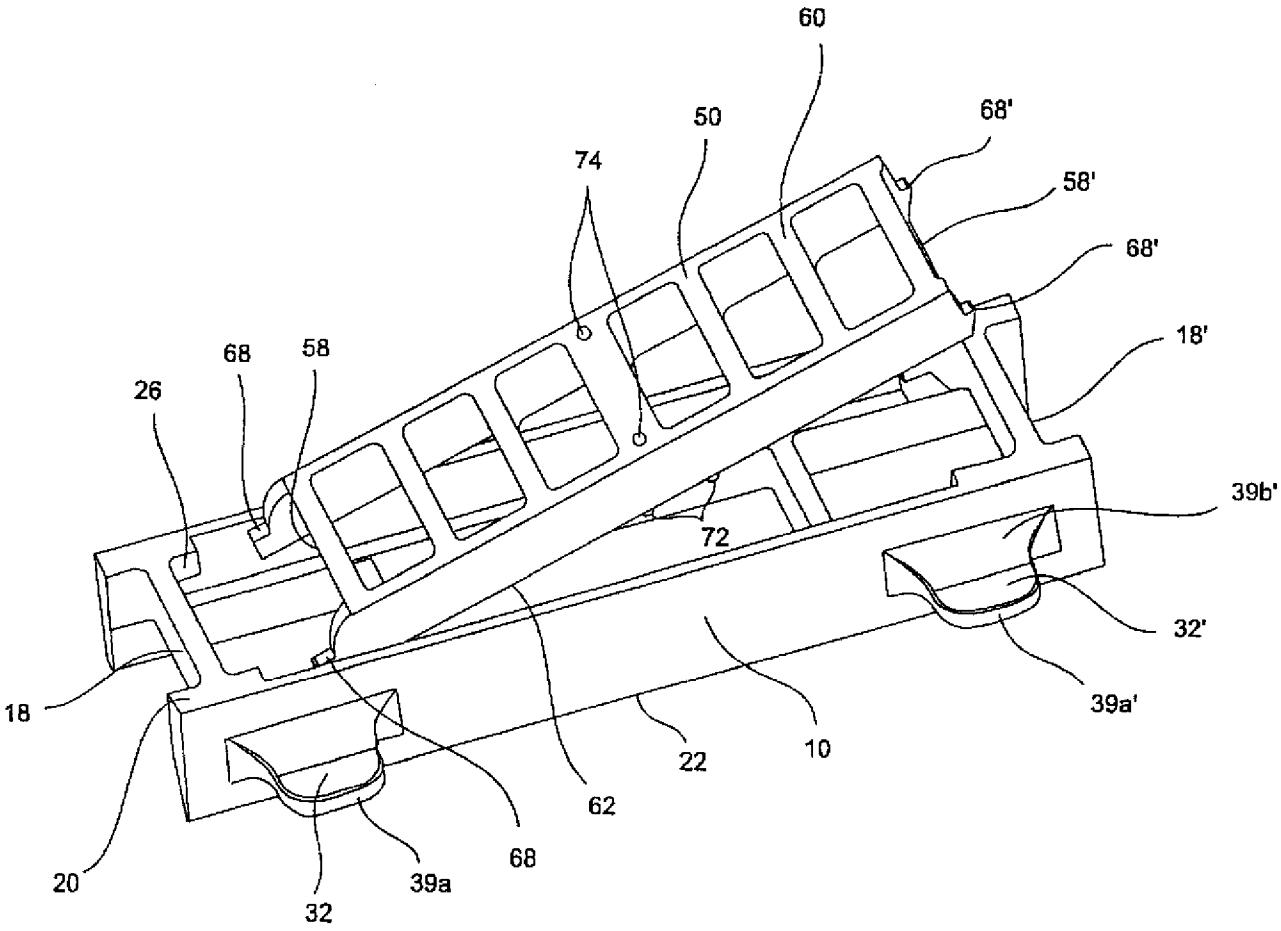

In operation and, as shown in FIG. 10, the grate frame 10 of the two-part grate assembly 2 is placed atop a channeled drain trough 4 that is substantially U-shaped having a hollow body portion 8 and ledges 6 and 6'. Such a channeled drain trough 4 is disclosed in U.S. Pat. No. 5,971,662, which is hereby incorporated by reference. The securing recesses 36 and 36' of the grate frame 10 assist in aligning and securing the grate frame 10 atop the channeled drain trough 4. The securing recesses 36 and 36' are dimensioned so that they are able to receive ledges 6 and 6' of the channeled drain trough 4. Further, the lugs 32 and 32' and vertical projections 34 and 34' stabilize the grate frame 10 once earthen fill or concrete is placed around the grate frame 10 and the channeled drain trough 4. As shown in FIGS. 1 and 11, upon placement of the grate section 50 within the grate frame 10, external projection 68 can be received by receiving recess 30 until the grate section 50 reaches or is stopped by internal projection 26 and the grate section 50 can be moved toward the second section or rear portion 28 of the grate frame 10 to permit reception of external projection 68' with receiving recess 30' of the grate frame 10 to permit seating of the grate section 50 on the ledge L (shown in FIGS. 2, 4-6 and 11) of the grate frame 10. In this orientation the external projections 68 and 68' of the grate section 50 co-act with the internal projections 26 and 26' of the grate frame 10 to prevent lifting of the grate section 50 from the grate frame 10. The projection 68' may have an upwardly sloping upper surface to mate with the downwardly sloping bottom surface of projection 26', if provided. As such, the external projections 68 and 68' are slidably received by the receiving recesses 30 and 30'; i.e., there is enough clearance so that there is not an interference fit at the co-acting areas. Once in this operating position, pullout resistance on the grate section 50 comes from the grate frame 10 itself. The grate section 50 is slidably moved along the X-axis shown in FIG. 2 until the extending portions 72 are positioned adjacent slots 38 and 38' so that the alignment bar 40 may be received into the slots 38 and 38'. To further prevent the grate section 50 from sliding out of the operating position, the alignment bar 40 is used to engage the grate frame 10 and the grate section 50 to prevent lateral movement along the X-axis. As shown in FIG. 6, the alignment bar 40 snaps into the clip 75 attached to extending portions 72 of the grate section 50. Preferably, two clips 75 are provided, each clip 75 attached to extending portions 72 near opposing interior sidewalls 52 and 52'. However, the alignment bar 40 may also snap into the grate frame 10. The alignment bar 40 may be brought into this operating position by hand or with the use of the hook end 78 of tool 42 with or without the use of hole 74, or a plurality of holes 74, within the grate section 50. Further, the alignment bar 40 may be released from this operating position using the elongated portion 80 of tool 42 through the hole 74, or a plurality of holes 74, of the grate section 50 to push the alignment bar 40 downwardly out of operating position. Once assembled, the two-part grate assembly 2 of the present invention is able to prevent injury to people and avoids substantially-sized debris from entering the channeled drain trough 4 because the internal projections 26 of the grate section 50 help to prevent entry into the hollow body 8 of the channeled drain trough 4. Further, complete access to the interior of the channeled drain trough 4 is easily and quickly achieved by removing the grate section 50 from the two-part grate assembly 2. Removal of the grate section 50 is easily accomplished by releasing the alignment bar 40 from the clip 75. Upon release of the alignment bar 40, the grate section 50 is slid along the X-axis relative to the grate frame 10 toward the first section or front portion 24 of the grate frame 10 until external projection 68' is completely exposed and not captured within receiving recess 30'. External projection 68' is pivoted in a counter clockwise direction W (shown in FIGS. 1 and 2) relative to the grate frame 10 so that external projection 68' can be released from receiving recess 30' at the second section or rear portion 28 of the grate frame 10. Upon release of external projection 68', the grate section 50 is slid along the X-axis relative to the grate frame 10 toward the second section or rear portion 28 of the grate frame 10 so that external projection 68 can be released from receiving recess 30 at the first section or front portion 24 of the grate frame 10. Upon release of external projections 68 and 68', the grate section 50 may be easily lifted upwardly out of operating position in the grate frame 10. The above method is reversed to place the grate section 50 into the grate frame 10. As is evident, sufficient clearances are provided between projections 26, 26' and external projections 68, 68' to permit removal of the grate section 50 from the grate frame 10.

The present invention is also directed to a method for providing a removable two-part grate assembly 2 for a channeled drain trough 4. As such, the method involves the following steps: a) providing: i) a grate frame 10 of the present invention, ii) a removable grate section 50 of the present invention, and iii) an alignment bar 40 of the present invention; b) aligning and placing the grate frame 10 over a channeled drain trough 4 and inserting the grate section 50 into the grate frame 10; inserting the alignment bar 40 into the slots 38 and 38' of the grate frame 10, whereby the alignment bar 40 engages the grate frame 10 and the grate section 50 to prevent lateral movement of the grate section 50 releasably secured within the grate frame 10; and d) engaging the alignment bar 40 with a clip 75 attached to the extending portions 72 of the interior ribwalls 64 of the grate section 50. The clip 75 has first and second leg portions, A and B respectively, for releasably attaching the alignment bar 40 thereto.

The present invention has been described with reference to the preferred embodiments. Modifications, combinations and alterations will occur to others upon reading the preceding detailed description. It is intended that the invention be construed as including all such modifications, combinations and alterations.

The invention claimed is:

1. A removable grate assembly for a channeled drain trough comprising:

a grate frame having a first section defining a first section interior endwall and a first section exterior endwall and a second section defining a second section interior endwall and a second section exterior endwall, said first section interior endwall and said second section interior endwall connected by two opposing sidewalls, said first section extending inwardly toward said first section interior endwall to form an internal projection defining a receiving recess on a side of said first interior endwall, said second section extending inwardly toward said second section interior endwall to form an internal projection defining a receiving recess on said second interior endwall, and a removable grate section having a first interior endwall, a first exterior endwall, a second interior endwall, and a second exterior endwall, said first interior endwall and said second interior endwall connected by two opposing sidewalls, said first exterior endwall having an external projection extending therefrom on a side of said first exterior endwall, said second exterior endwall having an external projection extending therefrom on a side of said second exterior endwall, said removable grate section removably received by said grate frame, wherein said external projection of said first exterior endwall is received within its corresponding receiving recess of said first interior endwall and said external projection of said second exterior endwall is received within its corresponding receiving recess of said second interior endwall.

2. The removable grate assembly of claim 1, wherein said receiving recess of said first section interior endwall of said grate frame being substantially rectangular in shape and said receiving recess of said second section interior endwall of said grate frame extending in a horizontal direction, said external projection of said first exterior endwall of said grate section being substantially rectangular in shape and said external projection of said second exterior endwall of said grate section extending in a horizontal direction.

3. The removable grate assembly of claim 1, wherein said grate frame has a lug extending from an exterior surface of an opposing sidewall.

4. The removable grate assembly of claim 3, wherein said lug has a projection depending therefrom, said lug and said projection defining a securing recess.

5. The removable grate assembly of claim 1, wherein said grate frame defines a slot on a first of said two opposing sidewalls that extends from an inner surface of an interior surface of said first opposing sidewall toward a respective outer surface of an exterior surface of said first opposing sidewall, wherein said grate frame defines a slot on a second of said two opposing sidewalls that extends from an inner surface of an interior surface of said second opposing sidewall toward a respective outer surface of an exterior surface of said second opposing sidewall.

6. The removable grate assembly of claim 5, further comprising an alignment bar that extends throughout the width of said grate frame, wherein said alignment bar engages said grate frame and said grate section to prevent lateral movement of said grate section secured within said grate frame when said alignment bar is removably received into said slots.

7. The removable grate assembly of claim 5, wherein said removable grate section has at least two interior ribwalls contained between said two opposing interior sidewalls, wherein said interior ribwalls have extending portions that protrude below a bottom surface of said grate section, wherein a hole spaced between said extending portions of said interior ribwalls extends from a top surface through said bottom surface of said grate section, said hole allowing access to manipulate said alignment bar.

8. The removable grate assembly of claim 7, wherein said alignment bar engages a clip attached to each respective extending portion of said interior ribwalls, said clip having first and second leg portions for releasably attaching said alignment bar thereto.

9. The removable grate assembly of claim 8, further comprising a tool having a hook end attached to an elongated portion, wherein said hook end of said tool captures a portion of said alignment bar to releasably engage said alignment bar with said clip upon lifting said alignment bar upwardly.

10. The removable grate assembly of claim 9, wherein said alignment bar has an intermediate portion positioned between a plurality of elastically deformable fins at opposing ends of said alignment bar, wherein upon releasable engagement of said alignment bar with said clip, said fins initially deform inwardly.

11. The removable grate assembly of claim 10, wherein after engagement of said alignment bar into said clip, said fins regain their original shape and become frictionally engaged with said clip.

12. The removable grate assembly of claim 10, wherein said center portion of said alignment bar is manufactured out of cast iron, ductile iron, stainless steel, or combinations thereof.

13. The removable grate assembly of claim 10, wherein said fins of said alignment bar are manufactured out of an elastomeric material.

14. A removable grate assembly comprising:

a grate frame having a body, said body defining an external surface and an internal surface, said internal surface defining a grate receiving recess, said body having a horizontally extending lug extending from said external surface and a projection depending from said lug defining a securing recess between a portion of said external surface, at least a portion of said lug and at least a portion of said projection, wherein said lug has a free end and a connected end, said projection positioned between said lug free end and said lug connected end; and a grate received by said grate receiving recess.

15. A removable grate assembly comprising:

a grate frame having a first section defining a first section interior endwall and a first section exterior endwall and a second section defining a second section interior endwall and a second section exterior endwall, said first section interior endwall and said second section interior endwall connected by two opposing sidewalls, said first section extending inwardly toward said first section interior endwall to form an internal projection defining a receiving recess on a side of said first interior endwall, said second section extending inwardly toward said second section interior endwall to form an internal projection defining a receiving recess on said second interior endwall, a removable grate section having a first interior endwall, a first exterior endwall, a second interior endwall, and a second exterior endwall, said first interior endwall and said second interior endwall connected by two opposing sidewalls, said first exterior endwall having an external projection extending therefrom on a side of said first exterior endwall, said second exterior endwall having an external projection extending therefrom on a side of said second exterior endwall, said removable grate section removably received by said grate frame, wherein said external projection of said first exterior endwall mates with its corresponding receiving recess of said first interior endwall and said external projection of said second exterior endwall mates with its corresponding receiving recess of said second interior endwall, and a drain trough that is substantially U-shaped having a hollow body portion and a ledge, said grate frame placed atop said ledge of said drain trough.

16. The removable grate assembly of claim 15, wherein said grate frame has a lug extending from an exterior surface of an opposing sidewall, said lug having a projection depending therefrom, said lug and said projection defining a securing recess, wherein said securing recess stabilizes and aligns said grate frame on said drain trough upon attachment of said grate frame upon said ledge of said drain trough.

17. A method for providing a removable grate assembly for a channeled drain trough, said method comprising the steps of:

a) providing:

i) a grate frame having a first section defining a first section interior endwall and a first section exterior endwall and a second section defining a second section interior endwall and a second section exterior endwall, said first section interior endwall and said second section interior endwall connected by two opposing sidewalls, said first section extending inwardly toward said first section interior endwall to form an internal projection defining a receiving recess on a side of said first interior endwall, said second section extending inwardly toward said second section interior endwall to form an internal projection defining a receiving recess on said second interior endwall, and ii) a removable grate section having a first interior endwall, a first exterior endwall, a second interior endwall, and a second exterior endwall, said first interior endwall and said second interior endwall connected by two opposing sidewalls, said first exterior endwall having an external projection extending therefrom on a side of said first exterior endwall, said second exterior endwall having an external projection extending therefrom on a side of said second exterior endwall, said removable grate section removably received by said grate frame, wherein said external projection of said first exterior endwall is received within its corresponding receiving recess of said first interior endwall and said external projection of said second exterior endwall is received within its corresponding receiving recess of said second interior endwall, and iii) an alignment bar, b) aligning and placing said grate frame over a channeled drain trough;

c) inserting said grate section into said grate frame; and d) inserting said alignment bar into a slot on a first of said two opposing sidewalls of said grate frame and into a slot on a second of said two opposing sidewalls of said grate frame; thereby locking said grate section to said grate frame.

18. The method for providing a removable grate assembly of claim 17, wherein said alignment bar has a center portion positioned between a plurality of elastically deformable fins at opposing ends of said alignment bar, wherein upon releasable engagement of said alignment bar with said clip, said fins initially deform inwardly.

19. The method for providing a removable grate assembly of claim 18, further comprising a tool having a hook end attached to an elongated portion, wherein said hook end of said tool captures a portion of said alignment bar to releasably engage said alignment bar with said clip upon lifting said alignment bar upwardly, wherein disengagement of said alignment bar is achieved upon placement of said elongated portion of said tool through a hole extending from a top surface through a bottom surface of said grate section that is spaced between at least two interior ribwalls of said grate section having extending portions, pushing said alignment bar downwardly.

* * * * *

UNITED STATES PATENT AND TRADEMARK OFFICE

CERTIFICATE OF CORRECTION

PATENT NO. : 7,588,392 B2
APPLICATION NO. : 11/789444
DATED : September 15, 2009
INVENTOR(S) : Wroblewski et al.

It is certified that error appears in the above-identified patent and that said Letters Patent is hereby corrected as shown below:

In The Drawings

Please substitute the attached formal drawing of Fig. 11 shown on sheet 8 of 8 of the drawings.

Signed and Sealed this

Sixteenth Day of February, 2010

David J. Kappos

David J. Kappos
*Director of the United States Patent and Trademark Office*